US006796745B2

(12) United States Patent
Kulchin

(10) Patent No.: US 6,796,745 B2
(45) Date of Patent: Sep. 28, 2004

(54) SOIL NAILING SYSTEM

(76) Inventor: Steven A. Kulchin, 7507 - 245th Way NE., Redmond, WA (US) 98053

( * ) Notice: Subject to any disclaimer, the term of this patent is extended or adjusted under 35 U.S.C. 154(b) by 0 days.

(21) Appl. No.: 10/246,106

(22) Filed: Sep. 17, 2002

(65) Prior Publication Data

US 2004/0052587 A1 Mar. 18, 2004

(51) Int. Cl.[7] ..... E21D 17/20; E21D 20/00
(52) U.S. Cl. ..... 405/259.1; 405/262; 405/284
(58) Field of Search ..... 405/259.1, 259.2, 405/259.5, 262, 284, 244, 172; 52/155, 156, 698, 707; 411/82, 258

(56) References Cited

U.S. PATENT DOCUMENTS

| | | | | |
|---|---|---|---|---|
| 3,893,303 A | | 7/1975 | Rotter | |
| 4,051,683 A | * | 10/1977 | Koval | 405/259.6 |
| 4,679,966 A | * | 7/1987 | Yacisin | 411/2 |
| 4,911,582 A | * | 3/1990 | Peirce et al. | 405/262 |
| 4,952,097 A | | 8/1990 | Kulchin | |
| 4,954,018 A | | 9/1990 | Gauna | |
| 4,955,758 A | | 9/1990 | Hyde | |
| 4,958,961 A | | 9/1990 | Herbst et al. | |
| 5,314,268 A | | 5/1994 | Calandra, Jr. et al. | |
| 5,395,185 A | * | 3/1995 | Schnabel, Jr. | 405/284 |
| 5,580,191 A | | 12/1996 | Egan | |
| 5,603,589 A | * | 2/1997 | von Allmen et al. | 405/259.5 |
| 5,653,557 A | * | 8/1997 | Gruber | 405/259.1 |
| 5,890,843 A | | 4/1999 | Bastick et al. | |
| 6,000,881 A | | 12/1999 | Becker et al. | |
| 6,113,313 A | | 9/2000 | Blair et al. | |

FOREIGN PATENT DOCUMENTS

| | | | | |
|---|---|---|---|---|
| JP | 63019327 | * | 1/1988 | 405/262 |

* cited by examiner

*Primary Examiner*—Jong-Suk (James) Lee
(74) *Attorney, Agent, or Firm*—Christensen O'Connor Johnson Kindness PLLC

(57) ABSTRACT

A soil nailing system includes a temporary retaining wall for an excavation sidewall. Soil nails extend outwardly into the soil sidewall and are integrated with the temporary retaining wall. The soil nails comprise an easily shearable reinforcing rod made, for example, of fiberglass so that the area containing the soil nails can be excavated after permanent walls are provided in the excavation.

1 Claim, 2 Drawing Sheets

SOIL NAILING SYSTEM

FIELD OF THE INVENTION

This invention relates to temporary retaining walls and methods for making the same adjacent property to be excavated in the future.

BACKGROUND OF THE INVENTION

Excavations for buildings normally must be shored so that the sidewalls of the excavation do not cave in during construction of permanent load-bearing walls. One method for shoring the sidewalls of the excavation is to use soil nailing techniques. In the past, soil nailing techniques have utilized steel anchor rods that are inserted in holes drilled into the sidewall of the excavation. The holes are placed several feet apart in both the horizontal and vertical directions. These holes are then filled with a cementitious material such as grout that surrounds the steel anchor rod. A shoring wall is then formed, for example, by shot construction, against the side of the excavation and tied to the steel anchor rods and cementitious filler material. Normally, these shoring walls are built in four-foot to six-foot high increments as the excavation is dug deeper. The permanent load-bearing walls are then normally built from the bottom up on the inside of the shoring walls.

Almost always reinforcing rods and the surrounding concrete grout extend into rights-of-way adjacent to the building construction site. It is desirable to be able to excavate in these rights of way after the original building is finished. In many instances, it is desirable to excavate these adjacent rights-of-way or property. It is difficult to do so and very hard on excavating equipment when the steel rods are left in place. Thus, the steel rods are normally removed through the permanent load-bearing wall after it is completed. In order to do this, however, a hole must be left in the permanent wall. After the steel rods are removed through the hole, the hole must be patched with concrete and the resulting wall fully water sealed. This process leads to significant extra expense as well as complications in assuring waterproofing of the below ground load-bearing walls.

SUMMARY OF THE INVENTION

The present invention comprises a soil nailing system that extends into property adjacent an excavation that can later be excavated without encountering steel rod obstructions that can result in damage to excavation equipment. The soil nailing system includes a temporary retaining wall for the sidewall of the soil excavation. Soil nails are extended outwardly into the soil sidewall. The soil nails comprise an easily shearable reinforcing rod, preferably made of fiber reinforced polymer, surrounded by grout or other cementitious material. This grout or cementitious material is integrally tied to the temporary retaining wall for the soil excavation. Thereafter, a permanent cementitious wall is formed inwardly of the temporary retaining wall. This construction eliminates the need for removing the steel rods used in prior soil nailing techniques. In addition, the property adjacent the temporary retaining wall can easily be excavated with conventional excavating equipment without harm to the equipment or to the original retaining wall or associated permanent structure. Use of the invention leads to significant savings over the prior art methods that require steel rod removal, and also reduces the easement fees that must be paid to an adjacent landowner.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
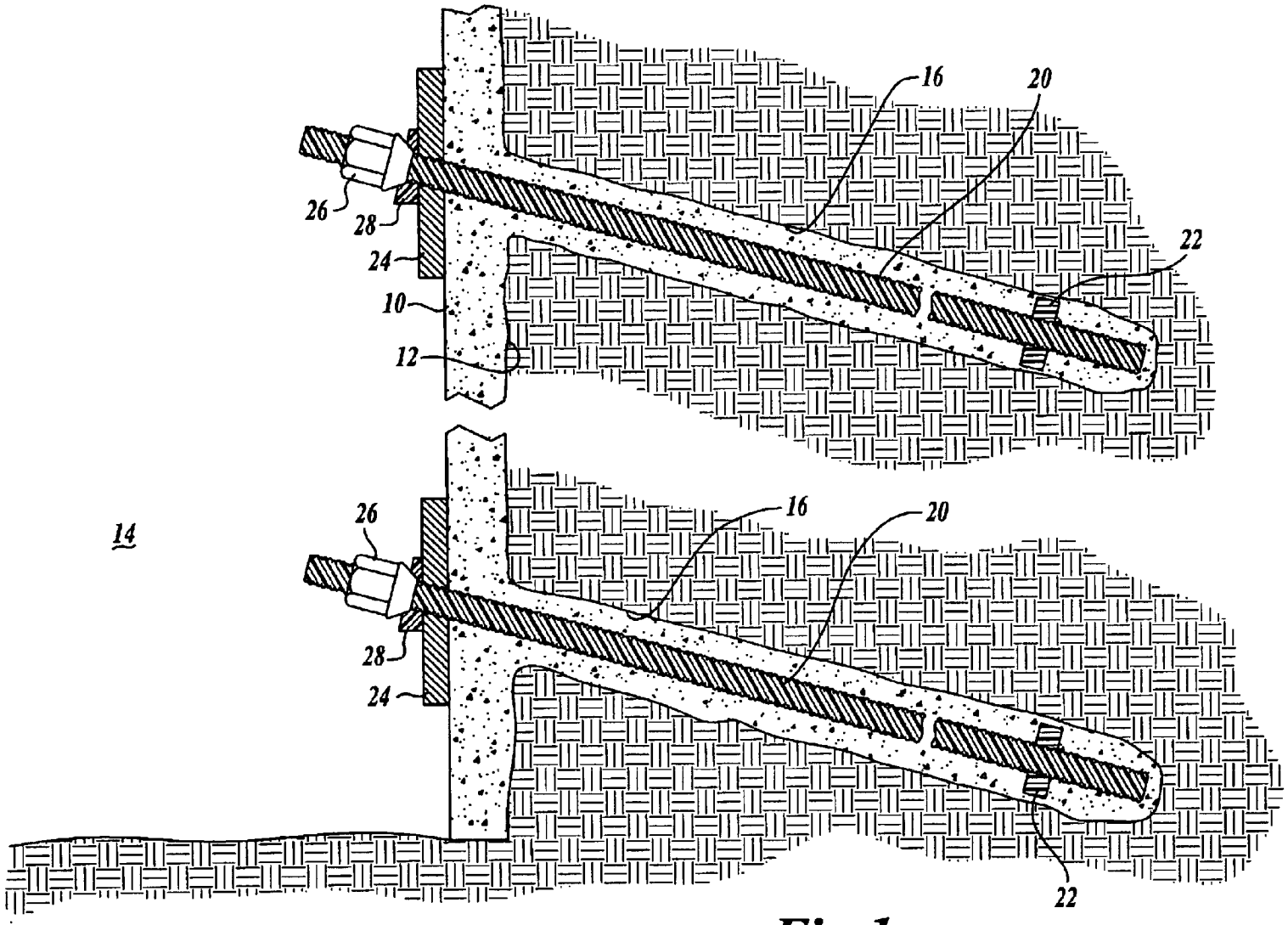
FIG. 1 is a side elevation view and partial cross section of a temporary retaining wall and soil nails constructed in accordance with the present invention.

Referring first to FIG. 1, a temporary retaining wall 10 is formed against the sidewall 12 of a soil excavation 14. Prior to forming the retaining wall 10, bores 16 are bored outwardly into the sides of the soil excavation. These bores are generally bored at downward angle on the order of 10° to 20°, preferably on the order of 15°. These bores are generally spaced in an array on the sidewall of the soil excavation several feet apart in both the vertical and horizontal directions. Retaining wall 10 is formed in vertical lifts as the soil is removed from the excavation 14. Generally, soil is removed in lifts of approximately four to six feet, depending upon the condition of the soil. The bores 16 are then formed thereafter.

Reinforcing rods 20 are inserted into the bores 16. The distal end of the rods carry conventional centering devices 22 that maintain the rods 20 approximately in the center of the bore. One or more of the centering devices 22 can be utilized to assure that the rods 20 remain in the center of the bores 16 throughout its length. The rods 20, in accordance with the present invention, are composed of a material that is easily shearable in a transverse direction, and that yet has adequate tensile strength to provide lateral reinforcement to the temporary retaining wall 10. Preferred materials for the rods include fiberglass reinforced polymers, typically referred to as fiberglass.

After a rod 20 is inserted into a bore 16, cementitious material, ordinarily grout, is "tremie" placed, that is, first injected into the bottom end of bore 16, and then inwardly toward the wall of the excavation, to completely surround the rod 20. The face of the retaining wall 10 is then formed. This can be done in any of a variety of conventional manners, using for example, a conventional cementitious material that is poured or that can be blown onto the sidewall. The blowable material is normally referred to as shotcrete. The cementitious materials in the bore and the wall are normally allowed to cure simultaneously, thus making an integrated retaining wall with soil nails.

The rods 20 have sufficient length so they extend inwardly into the excavation 14 sufficiently so that they also extend through the retaining wall 10. Preferably, a reinforcing plate 24 is positioned around the rod 20 and against the inner side of the temporary retaining wall 10. The inner end of the rod 20 is preferably threaded and a large nut 26 is threaded onto the end of the rod against a washer 28, which in turn bears against the reinforcing plate 24. Other suitable connectors known in the art may also be employed. Once the cementitious materials are cured, the nut 26 is tightened until the proper tension is placed against the plate 24 and the wall 10. Thereafter, subsequent lifts of soil are removed from the excavation and additional segments of the temporary retaining wall are serially produced as the lifts are removed from the excavation.

The rods preferably used in accordance with the present invention are available from Dywidag Systems Int'l, of Bolingbrook, Ill., under the trade name Glass Fiber Anchors.

These rods have a tensile strength on the order of from 40000 psi to 60000 psi. These rods are also advantageous because their lateral breaking strength can be designed by the appropriate choice of manufacturing resins known in the art, so that it actually reduces over time. Thus, the more time that passes between their installation and excavation eases the task of breaking through them when eventually excavated.

Figure 2:
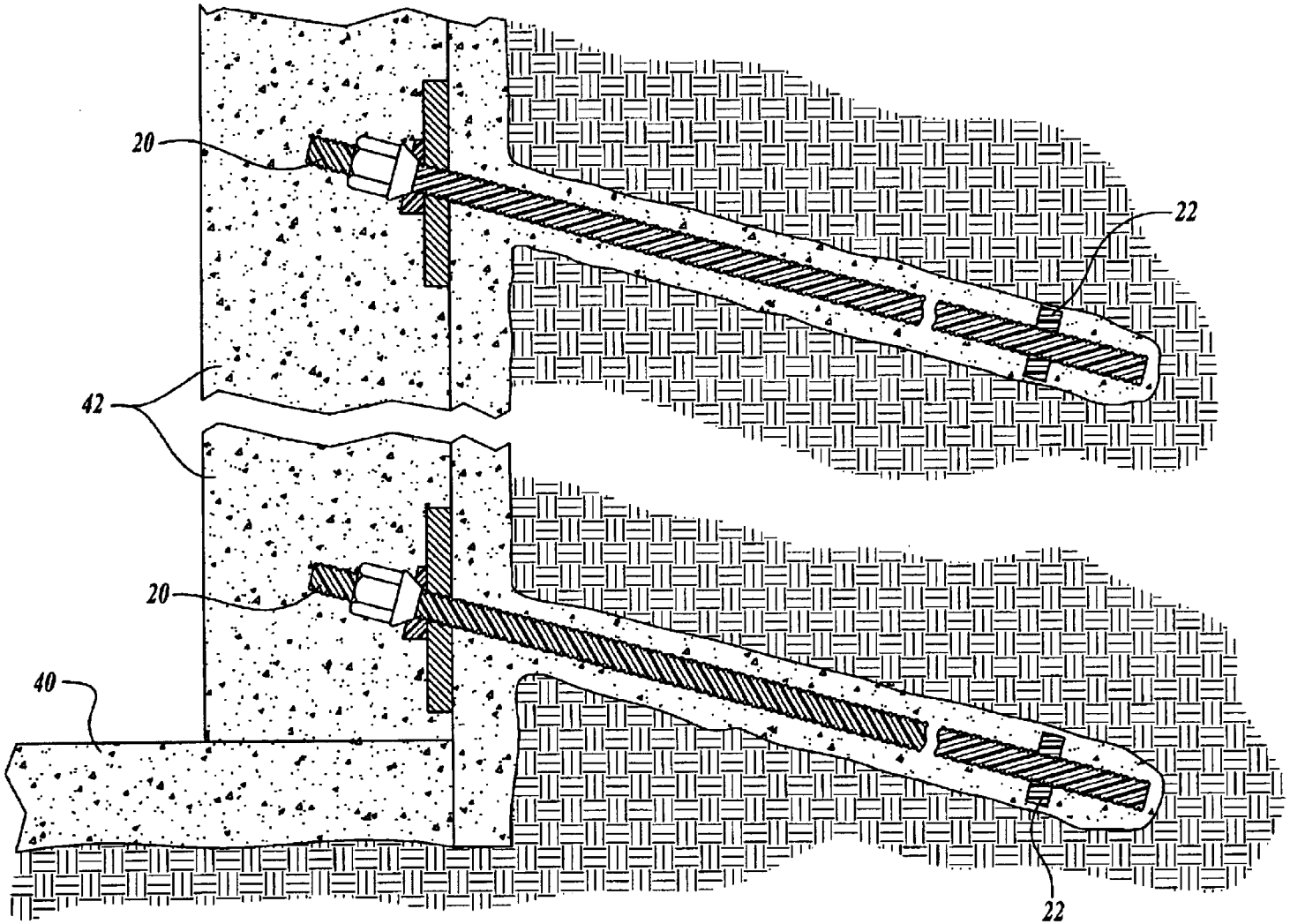
FIG. 2 is a view similar to FIG. 1 showing a permanent wall formed inwardly of the temporary retaining wall.

Referring now to FIG. 2, a permanent concrete floor 40 is formed on the bottom of the soil excavation 14. A separate permanent vertical wall 42 is then formed against the temporary retaining wall 10. This wall is designed to permanently bear the lateral loads of the excavation, and once in place alleviates the need for the temporary shoring wall and associated fiberglass anchor roads. The ends of the rod 20 are completely encased in the permanent wall 42. The present invention thus eliminates the need for the holes otherwise required for removal of the prior art steel reinforcing rods. Thus the need to patch and seal the permanent wall 42 after rod removal is also eliminated. The present invention therefore provides much more permanent and trouble-free permanent wall 42, as well as a more uniform and aesthetic interior finish. In addition, the soil nails comprising the fiberglass rods can easily be excavated without damage to the excavating equipment or the permanent load-bearing wall. By excavation it is meant any removal of material manually or by machine that would require breaking through a fiberglass anchor rod and its surrounding grout.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method for making a temporary retaining wall for a soil excavation, said soil excavation having a sidewall, said retaining wall having portions adjacent to adjoining property to be excavated, said method comprising the steps of:

boring holes in the sidewall of said soil excavation;

inserting easily shearable reinforcing rods into said holes;

forming a temporary retaining wall adjacent the sidewall of said excavation;

filling said holes with and forming a temporary retaining wall from cementitious material;

tying said rods to said retaining wall;

forming a separate, permanent, lateral load-bearing wall inwardly of said temporary retaining wall; and thereafter, excavating said adjoining property by shearing said rods and surrounding cementitious material as said adjoining property is excavated.

* * * * *